US009033020B2

(12) United States Patent
Matsumoto et al.

(10) Patent No.: US 9,033,020 B2
(45) Date of Patent: May 19, 2015

(54) LABELING DEVICE

(75) Inventors: Toshikazu Matsumoto, Yokohama (JP); Yoshimi Hirasawa, Yokohama (JP); Yasushi Nakano, Yokohama (JP); Mitsuyuki Suzuki, Shiki (JP); Kazuo Kuwahara, Shiki (JP); Masashi Hamano, Shiki (JP); Takeshi Yokochi, Shiki (JP)

(73) Assignees: Techno Medica Co., Ltd., Kanagawa (JP); Autonics Co., Ltd., Saitama (JP)

( * ) Notice: Subject to any disclaimer, the term of this patent is extended or adjusted under 35 U.S.C. 154(b) by 205 days.

(21) Appl. No.: 13/882,036

(22) PCT Filed: Oct. 29, 2010

(86) PCT No.: PCT/JP2010/069343

§ 371 (c)(1),
(2), (4) Date: Apr. 26, 2013

(87) PCT Pub. No.: WO2012/056571

PCT Pub. Date: May 3, 2012

(65) Prior Publication Data

US 2013/0213577 A1 Aug. 22, 2013

(51) Int. Cl.
*B65C 9/18* (2006.01)
*B41J 3/407* (2006.01)
(Continued)

(52) U.S. Cl.
CPC ..... *B65C 9/18* (2013.01); *B65C 9/1865* (2013.01); *B41J 3/4075* (2013.01); *B65H 16/028* (2013.01); *B65H 16/106* (2013.01); *B65H 2301/41374* (2013.01); *B65H 2301/414225* (2013.01);
(Continued)

(58) Field of Classification Search
CPC ..... B65C 9/1865
USPC ..... 156/714, 719, 764, 766, 767
See application file for complete search history.

(56) References Cited

U.S. PATENT DOCUMENTS 5,209,374 A 5/1993 Seidl-Lichthardt
6,092,945 A 7/2000 Takami et al.
(Continued)

FOREIGN PATENT DOCUMENTS

JP H06-32337 A 2/1994
JP 11-171155 A 6/1999
(Continued)

OTHER PUBLICATIONS

International Search Report for PCT/JP2010/069343, ISA/JP, mailed Nov. 30, 2010.

*Primary Examiner* — Mark A Osele
(74) *Attorney, Agent, or Firm* — Harness, Dickey & Pierce, PLC

(57) ABSTRACT

A labeling device comprising a guide frame, rotatably supporting a label roll formed by winding around a core a label holding band, which releasably holds a plurality of labels in series, and a peeling member which peels the printed label from the band by bending the band at an acute angle towards a slanting lower part in relation to the direction of movement of the band. The labeling device comprises a guide unit that is pivotally provided for nipping and holding a leading edge of the label holding band in front of the peeling member and is rotatable around the peeling member with the leading edge of the band so that the leading edge of the band is automatically brought to a feeding roller arranged on the slanting lower part of the peeling member in relation to the direction of the movement of the label holding band.

11 Claims, 12 Drawing Sheets

(51) Int. Cl.
*B65H 16/02* (2006.01)
*B65H 16/10* (2006.01)
*B65C 9/42* (2006.01)

(52) U.S. Cl.
CPC ..... *B65H2301/41522* (2013.01); *B65H 2301/5111* (2013.01); *B65H 2301/51122* (2013.01); *B65H 2404/14* (2013.01); *B65H 2513/114* (2013.01); *B65H 2553/22* (2013.01); *B65H 2801/75* (2013.01); *B65C 9/1869* (2013.01); *B65C 9/42* (2013.01)

(56) References Cited

U.S. PATENT DOCUMENTS

| | | | | |
|---|---|---|---|---|
| 6,349,756 | B1 * | 2/2002 | Brough et al. | 156/767 |
| 6,505,981 | B1 | 1/2003 | Takami et al. | |
| 6,527,026 | B1 * | 3/2003 | Huggins | 156/387 |
| 2004/0079490 | A1 * | 4/2004 | Ito | 156/584 |
| 2005/0121146 | A1 | 6/2005 | Leonard et al. | |
| 2006/0027333 | A1 * | 2/2006 | Takami et al. | 156/584 |
| 2011/0214820 | A1 * | 9/2011 | Sato | 156/764 |

FOREIGN PATENT DOCUMENTS

| | | | |
|---|---|---|---|
| JP | 2000-211621 | A | 8/2000 |
| JP | 2008-155932 | A | 7/2008 |
| JP | 2009-113270 | A | 5/2009 |

* cited by examiner (a)

(b)

(c)

(d)

(e)

(f)

(g)

(h)

(i)

(j)

(k)

(a)

(b)

(c)

(d)

(e)

(a)

(b)

LABELING DEVICE

CROSS-REFERENCE TO RELATED APPLICATIONS

This application is a 371 U.S. National Stage of International Application No. PCT/JP2010/069343, filed Oct. 29, 2010, the entire disclosures of which application are incorporated herein by reference.

FIELD OF THE INVENTION

The present invention relates to an improvement of a labeling device which pulls out a label holding band releasably holding a plurality of labels in series thereon from a label roll, peels the label from the label holding band, and then puts the peeled label on the surface of a subject, such as a test tube.

BACKGROUND OF THE INVENTION

A known labeling device pulls out the label holding band from the label roll, peels a label from the label holding band, and then puts the peeled label on a surface of a subject, such as a test tube (refer to patent documents 1).

FIG. 8 is a schematic diagram showing the construction of the conventional labeling device. Numeral 100 indicates the label roll in the figure. This label roll 100 is formed by winding around a winding core 103 the label holding band 102 which releasably holds a plurality of labels 101 on one surface thereof.

The label roll 100 is mounted on a shaft 104. The label holding band 102 of the label roll 100 is continuously drawn out by a platen roller 105.

Numeral 106 indicates a printing head. The printing head 106 prints suitable information on the surface of the label 101 held on the label holding band 102.

The label holding band 102 passes through and advances under the printing head 106, is bent at an acute angle by a peeling plate 107, and then passes between a pair of feeding rollers 108 which are arranged under the peeling plate 107. With constituting the device in this way, when the label holding band 102 passes the peeling plate 107, the label holding band 102 is bent at the acute angle by the peeling plate 107, and the label 101 is peeled from the label holding band 102. Peeled label 101 is put on suitable pasting subjects 110, such as a test tube, by means of a pasting roller 111. Numeral 112 indicates an auxiliary roller in FIG. 8.

PRIOR ART DOCUMENT

Patent Documents

[Patent documents 1] JP2009-113270A gazette

DESCRIPTION OF THE INVENTION

Problems to be Solved by the Invention

In the conventional labeling device constituted as described above, the label holding band 102 is automatically and successively pulled out by the platen roller 105 from the label roll 100 when the device is operated. In the conventional labeling device, after putting a label roll 100 on the labeling device a leading edge of the label holding band 102 of the label roll 100 is positioned over the platen roller 105 and then is inserted between the feeding rollers 108, the device has a problem that these operations must be manually performed by an operator. For this reason, there was a problem that it took time and effort to set the label roll 100 in the labeling device, or to exchange the consumed label roll 100 for new one.

An object of the present invention solves the above-mentioned conventional problems and is to provide the labeling device which automatically pulls out a leading edge of the label holding band from the label roll, and brings the leading edge of the label holding to the feeding roller, without the operations of the operator, after putting the label roll on the labeling device.

Means for Solving the Problem

In order to achieve the above mentioned object, according to the present invention, there is provided a labeling device comprising a guide frame rotatably supporting a label roll formed by winding around a core a label holding band which releasably holds a plurality of labels in series and a peeling member which peels the printed label from the label holding band by bending the label holding band at an acute angle towards a slanting lower part in relation to the direction of movement of the label holding band characterized in that the labeling device comprises a guide unit that is pivotally provided for nipping and holding a leading edge of the label holding band in front of the peeling member and is intended to be rotated around the peeling member with the nipped and held leading edge of the label holding band so that the leading edge of the label holding band is brought to a feeding roller arranged on the slanting lower part of the peeling member in relation to the direction of the movement of the label holding band.

Preferably, at least one pair of loading rollers may be provided between the guide frame and the peeling member, and the label holding band may be passed through between said loading rollers and is fed to the peeling member by rotating the loading rollers.

Also a printing head may be arranged between the loading rollers and the peeling member for printing any information on a label on the label holding band pulled out from the label roll.

Furthermore, a platen roller may be arranged under the printing head, the printing head may have a pivot axis at the one end opposite to the platen roller and be rotatable about the pivot axis, until tensile force is applied to the label holding band by the feeding roller the printing head may be rotated to the position in which the printing head is away from the platen roller, and after the suitable tensile force is applied to the label holding band the printing head may be rotated about the pivot axis to the position in which the printing head is contacted with the platen roller via the label holding band.

Furthermore, the guide unit may comprise a guiding roller and a label fitting plate which are intended to nip the leading edge of the label holding band between them in front of the peeling member, the guide unit may be rotated to bring the leading edge of the label holding band to the feeding roller, and when the leading edge is brought to the feeding roller, the leading edge may nipped between the guiding roller and the feeding roller and the label holding band may be pulled out by the feeding roller.

Effect of the Invention

According to the present invention, a labeling device comprising a guide frame rotatably supporting a label roll formed by winding around a core a label holding band which releasably holds a plurality of labels in series and a peeling member which peels the printed label from the label holding band by bending the label holding band at an acute angle towards a slanting lower part in relation to the direction of movement of the label holding band characterized in that the labeling device comprises a guide unit that is pivotally provided for nipping and holding a leading edge of the label holding band in front of the peeling member and is intended to be rotated around the peeling member with the nipped and held leading edge of the label holding band so that the leading edge of the label holding band is brought to a feeding roller arranged on the slanting lower part of the peeling member in relation to the direction of the movement of the label holding band. Therefore, after putting the label roll on the labeling device, it becomes possible to fully automatically to pulls out the leading edge of the label holding band from the label roll, and brings the leading edge of the label holding band to the feeding roller, without the operation of operator.

BRIEF DESCRIPTION OF THE DRAWINGS

FIG. 5(*b*) illustrates the operation of the labeling device.

FIG. 5(*c*) illustrates the operation of the labeling device.

FIG. 5(*d*) illustrates the operation of the labeling device.

FIG. 5(*e*) illustrates the operation of the labeling device.

FIG. 5(*f*) illustrates the operation of the labeling device.

FIG. 5(*g*) illustrates the operation of the labeling device.

FIG. 5(*h*) illustrates the operation of the labeling device.

FIG. 5(*i*) illustrates the operation of the labeling device.

FIG. 5(*j*) illustrates the operation of the labeling device.

FIG. 5(*k*) illustrates the operation of the labeling device.

FIG. 6 (*b*) is an enlarged drawing of a portion of the labeling device corresponding to FIG. 5 (*g*).

FIG. 6 (*c*) is an enlarged drawing of a portion of the labeling device corresponding to FIG. 5 (*h*).

FIG. 6 (*d*) is an enlarged drawing of a portion of the labeling device corresponding to FIG. 5 (*i*).

FIG. 6 (*e*) is an enlarged drawing of a portion of the labeling device corresponding to FIG. 5 (*j*).

BEST MODE OF CARRYING OUT THE INVENTION

Hereinafter, the embodiment of the labeling device according to the present invention will be described with reference to one example shown in the accompanying drawing.

Figure 1:
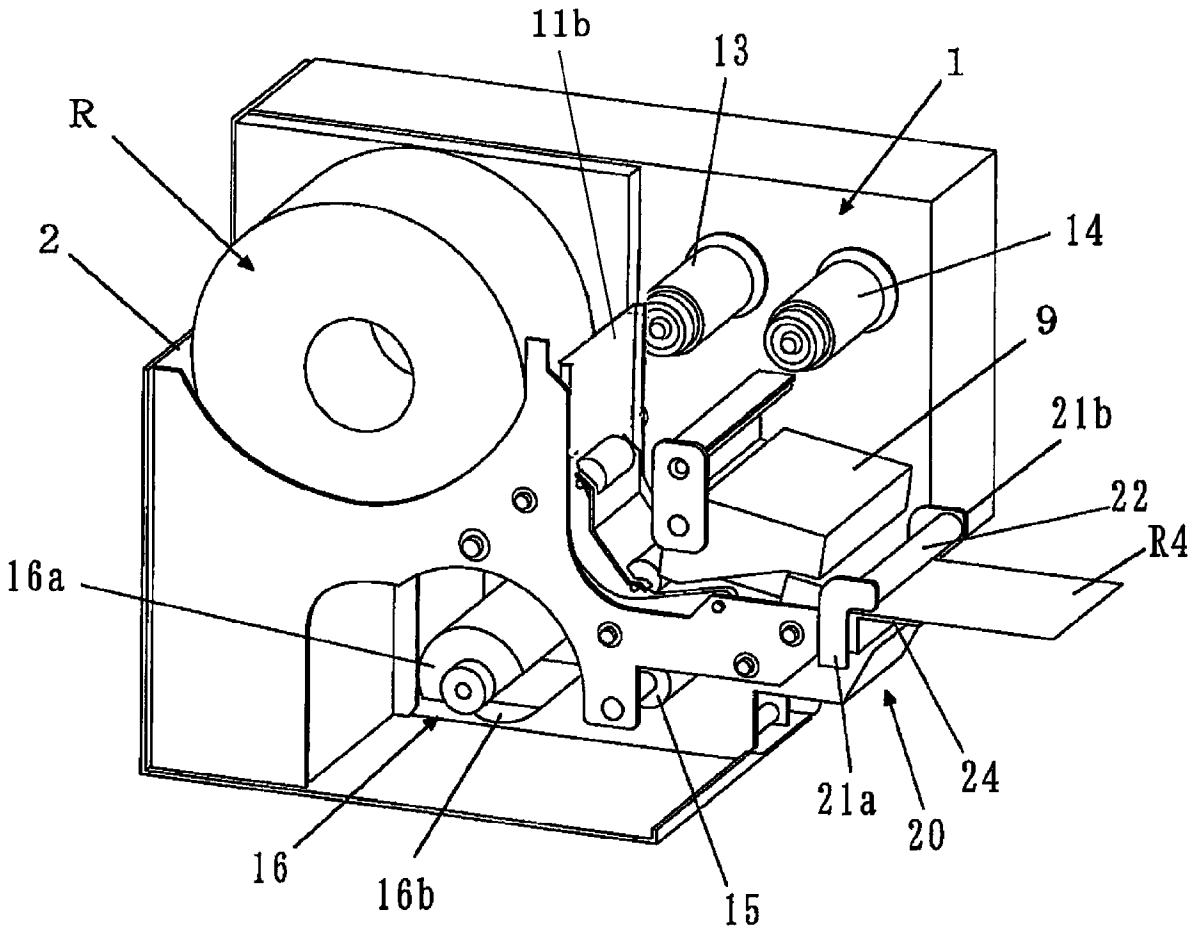
FIG. 1 is a diagrammatic perspective view showing obliquely the labeling device according to the present invention from above.
Figure 2:
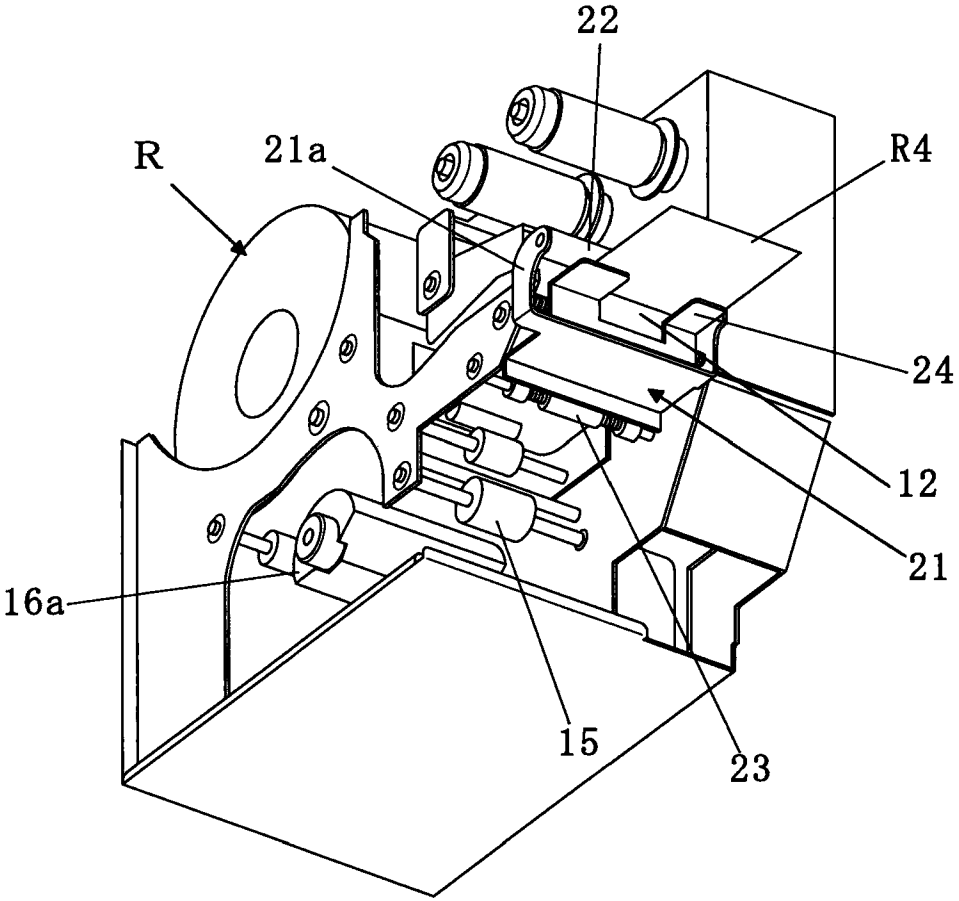
FIG. 2 is a diagrammatic perspective view showing obliquely the labeling device according to the present invention from below.
Figure 3:
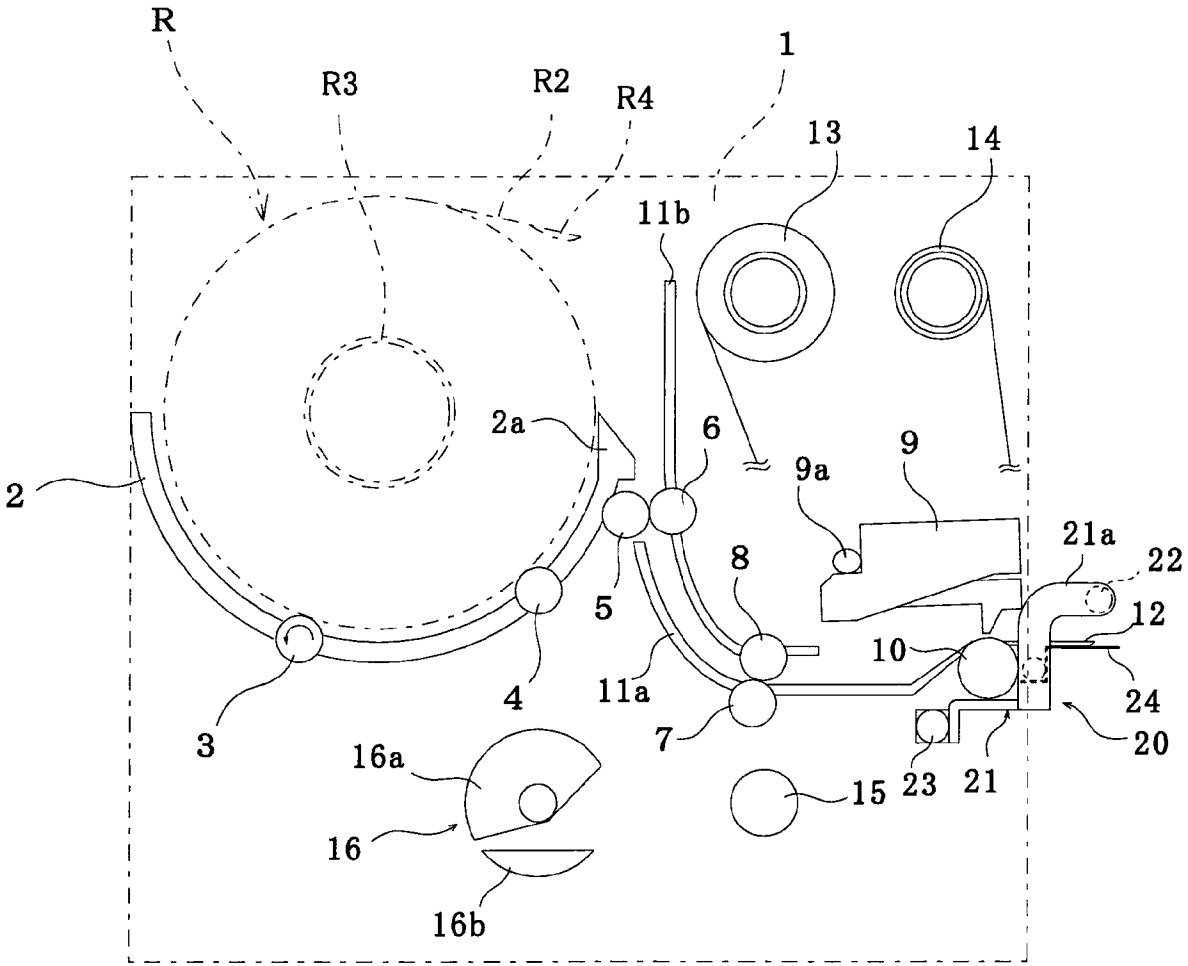
FIG. 3 is diagrammatically a front view of the labeling device, which shows only main components in order to explain the internal structure of the labeling device shown in FIG. 1.

FIG. 1 is a diagrammatic perspective view showing obliquely the labeling device according to the present invention from above. FIG. 2 is a diagrammatic perspective view showing obliquely the labeling device according to the present invention from below. FIG. 3 is a schematic front view of the labeling device, which indicates only main components, in order to explain the internal structure of the labeling device shown in FIGS. 1 and 2.

Numeral 1 indicates a basic frame in the figures. As shown in FIG. 3, a semicircular arc guide frame 2 is provided in the basic frame 1, and said guide frame 2 is opened towards the upper part. And two rollers 3 and 4 are arranged along with the guide frame 2. The roller 3 is driven by a motor not shown in figures, which is provided in the back side of the basic frame 1. The roller 4 rotates freely. A guiding part 2*a* is formed in the right end of the guide frame 2 in FIG. 3. Said guiding part 2*a* inclines towards the outside (right-hand side in FIG. 3) of the label roll R so that the leading edge of a label roll R may be advanced between a pair of first loading rollers 5 and 6 mentioned below.

Figure 4:
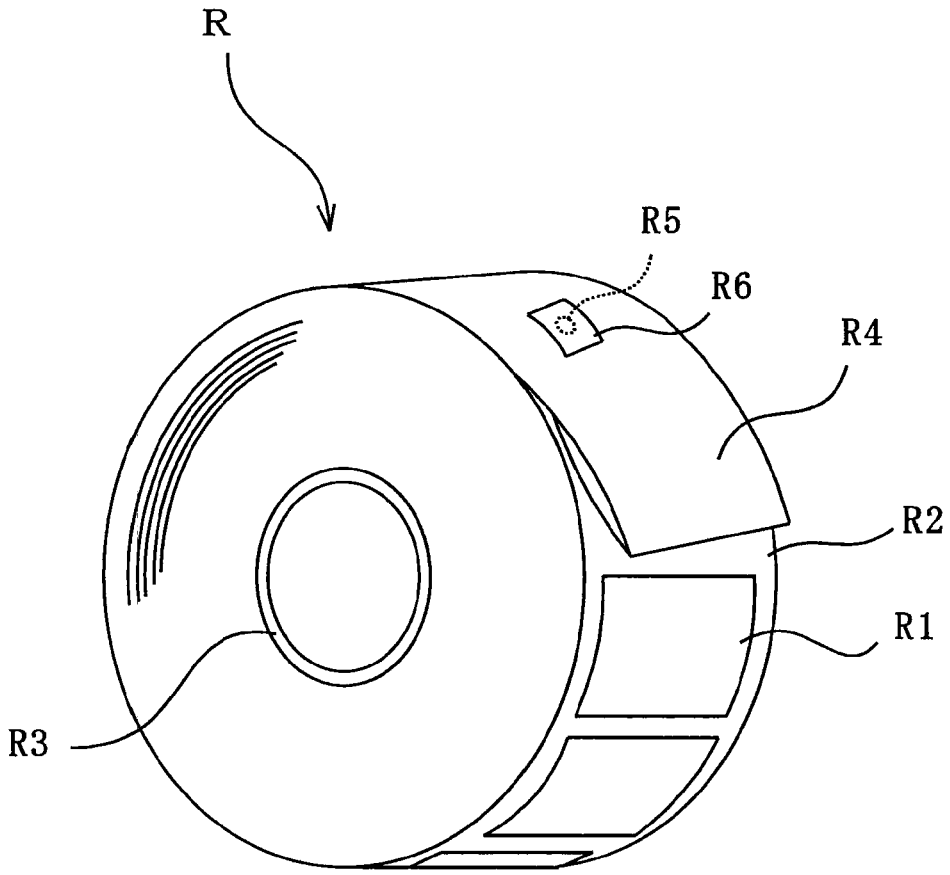
FIG. 4 shows an example of the label roll.

Here, the structure of the label roll R will be explained briefly. The Label roll R is formed by winding a label holding band R2 around a core R3, as shown in FIG. 4. On the label holding band R2, a plurality of labels R1 are releasably provided in series. In this embodiment, a leading edge R4 of the label holding band R2 is folded so that the reading edge R4 of the label holding band R2 slightly swells outside (refer to FIG. 4). Thereby, when the label roll R is rotating within the guide frame 2, the leading edge R4 of the label holding band R2 is directed outside by the guiding part 2*a* and is guided towards between the above-mentioned first loading rollers 5 and 6 by the guiding part 2*a*.

As shown in FIG. 4, the label holding band R2 has a hole R5 that is arranged near the leading edge R4 of the band R2. And tape piece R6 is stuck so that the above-mentioned hole R5 may be covered. Thereby, before using the label roll R, the leading edge R4 of band R2 is stopped on the main part of label roll R by tape piece R6 via the above-mentioned hole R5. The leading edge R4 may easily separate from the main part of the label roll R at the time of use by restricting a field which sticks the leading edge R4 of the label holding band R2 on the main part of the label roll R only to hole R5.

It returns to explanation of the construction of the labeling device again. Under the guiding part 2*a* in the basic frame 1, a pair of first loading rollers 5 and 6 is arranged.

A pair of second loading rollers 7 and 8 are arranged downstream of the first loading rollers 5 and 6 along the direction of movement of the label holding band R2. A printing head 9 and a platen roller 10 which constitute a printer (with no numeral) are arranged in front of the second loading rollers 7 and 8 along the direction of movement of the label holding band R.

Between the first loading rollers 5 and 6 and the printing head 9, a pair of guide plates 11*a* and 11*b* are arranged so that the label holding band may pass between the second loading rollers 7 and 8. The upper guide plate 11*b* is extended to the upper side of the first loading roller 6, and it acts so that the leading edge of the label holding band R2 may be guided between a pair of first loading rollers 5 and 6 with the above-mentioned guiding part 2*a*.

A peeling member 12 is provided in front of the printing head 9 and the platen roller 10 (right-hand side in FIG. 3) in relation to the direction of movement of the label holding band. By the peeling member 12, the label holding band R2 is bent at an acute angle in relation to the direction of movement of the label holding band, and, thereby, the label R1 is peeled from the label holding band R2.

Numeral 13 indicates a ribbon feeding roller which constitutes a part of the printer in the FIG. 3. Numeral 14 indicates a ribbon rolling-up roller which constitutes a part of the printer.

A guide unit 20 is provided near the peeling member 12 in basic frame 1.

This guide unit 20 has a frame body 21. A pair of arms 21*a* and 21*b* are provided on one end of the frame body 21. A guiding roller 22 is arranged between the arms 21*a* and 21*b* (refer to FIGS. 1 and 2).

The other end of the frame body 21 is fixed to a shaft 23 provided on the basic frame 1 (refer to FIGS. 2 and 3).

A label fitting plate 24 is rotatably arranged between the arms 21*a* and 21*b*. The label fitting plate 24 is always forced by an axial spring (with no numeral) against the guiding roller 22.

The guide unit 20 constituted as described above is arranged so that the peeling member 12 may be located between the guiding roller 22 and the label fitting plate 24. By means of a motor (not shown) arranged on the back side of the basic frame 1, the shaft 23 is rotated via a timing belt (not shown) so that the guide unit 20 is rotated and the roller 22 of the unit 20 passes along the outside (left-hand side in FIG. 3) of the peeling plate 12.

A feeding roller 15 made of rubber for feeding the label holding band is provided on the basic frame 1. The feeding roller 15 is to be in contact with the guiding roller 22, when the guide unit 20 rotates to most left-hand side (refer to FIG. 5(*i*)). On the right-hand side of the feeding roller 15, a label holding band rolling-up roller 16 is arranged.

The rolling-up roller 16 comprises a first member 16*a* formed in the form of a fan, and a second member 16*b* of the shape of a cut piece of a circle. These first and second members 16*a* and 16*b* rotate together on the same axis. The leading edge of the label holding band R2 is inserted into a gap between the first member 16*a* and the second member 16*b*, which spreads toward the outside.

FIG. 3 shows the state where the guide unit 20 is located in most right-hand side. In FIG. 3, the guiding roller 22 is located above the peeling member 12. And label fitting plate 24 is separated from the guiding roller 22 against the force of the axial spring and is held under the peeling member 12. That is, in this state, the peeling member 12 is located between the guiding roller 22 and the label fitting plate 24.

Finally, the construction of the printing head 9 is explained briefly. The printing head 9 is fixed to a pivot shaft 9*a* penetrated to the back side of the basic frame 1. By the motor (not shown) provided on the back side of the basic frame 1, the pivot shaft 9*a* and thus the printing head 9 are rotated so that the printing head 9 takes the position where it separates from the platen roller 10 or the position where it contacts with the platen roller 10 and will be in the state which be able to print.

Hereinafter, the operation of the labeling device constituted as described above will be explained, referring to FIGS. 5 and 6.

Figure 5:
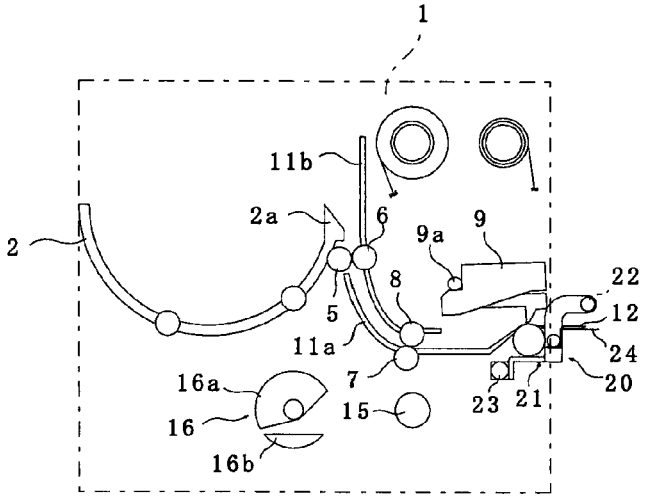
FIG. 5(*a*) illustrates an operation of the labeling device.
Figure 5:
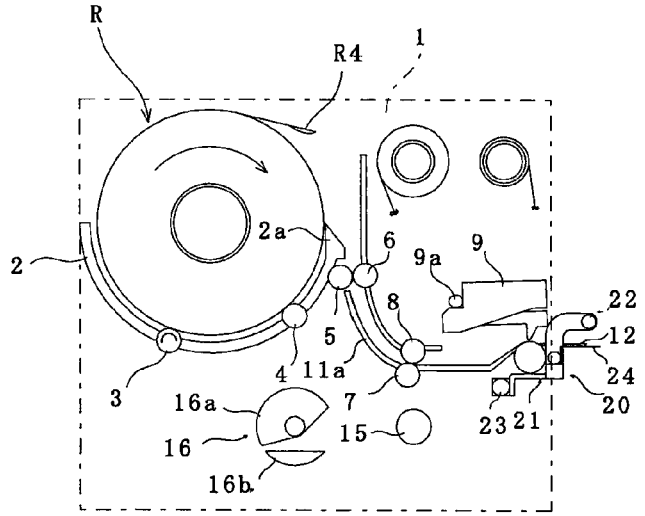
Figure 5:
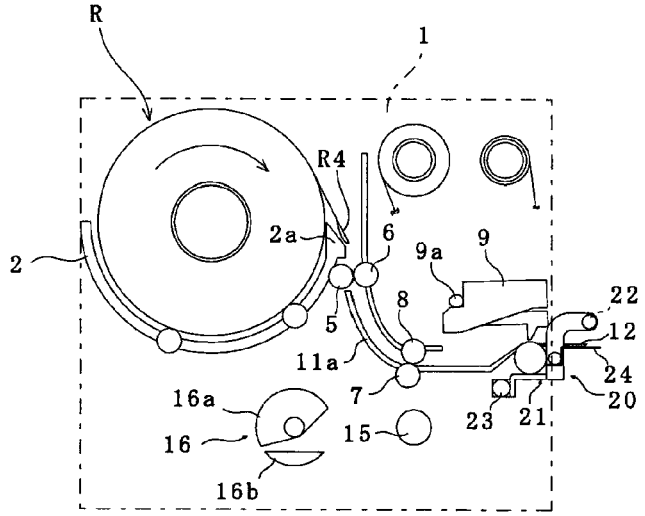
Figure 5:
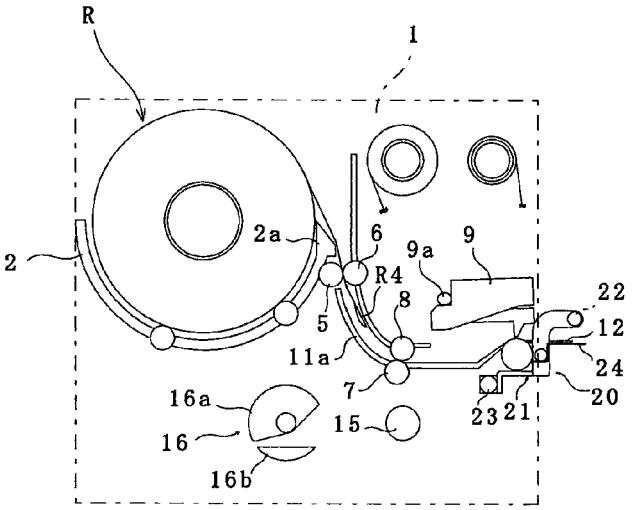
Figure 5:
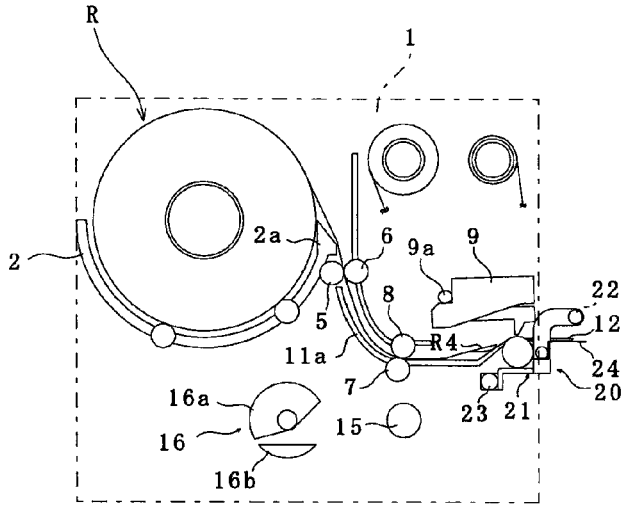
Figure 5:
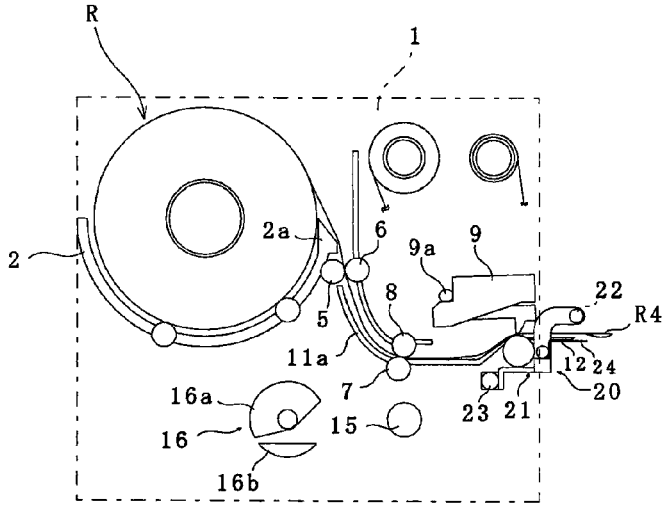
Figure 5:
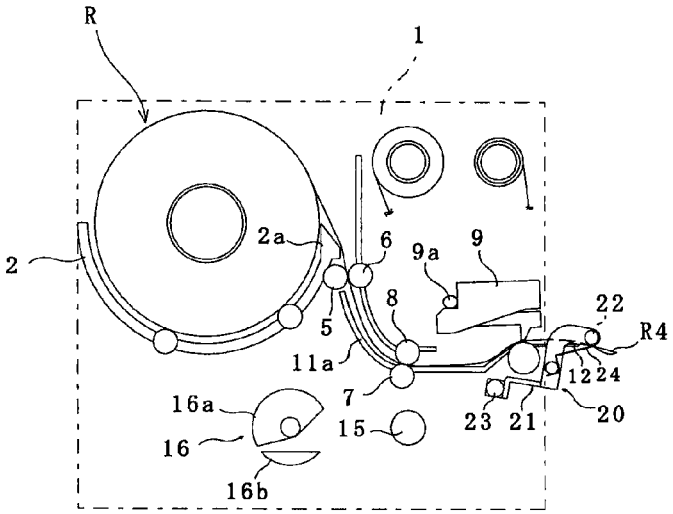
Figure 5:
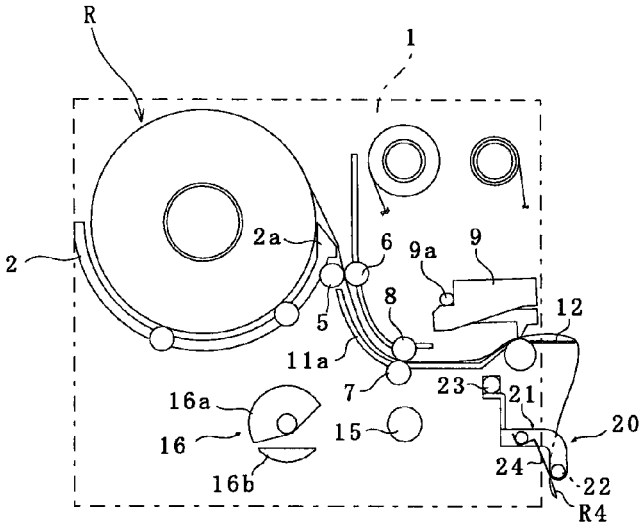
Figure 5:
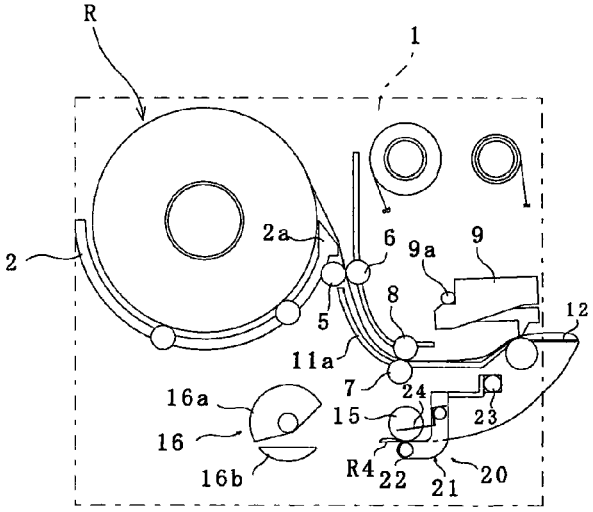
Figure 5:
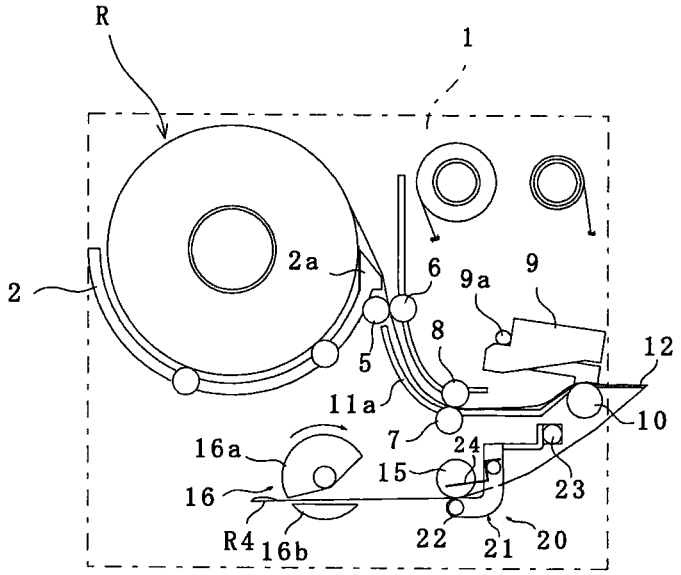
Figure 5:
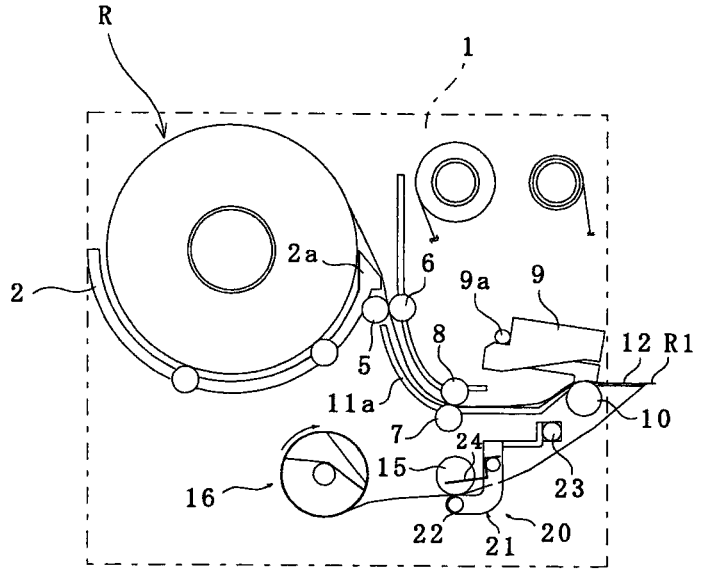
Figure 6:
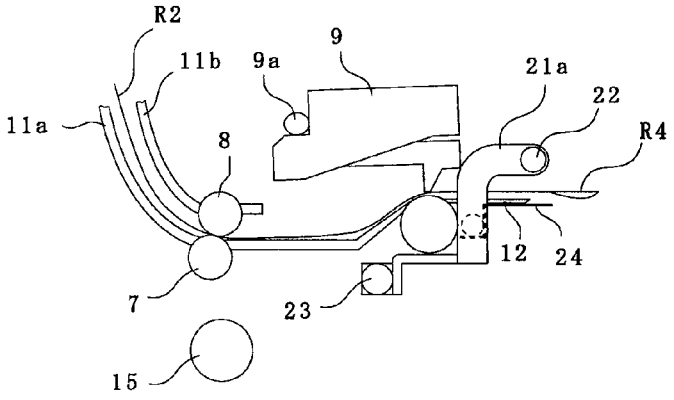
FIG. 6(*a*) is an enlarged drawing of a portion of the labeling device corresponding to FIG. 5(*f*).
Figure 6:
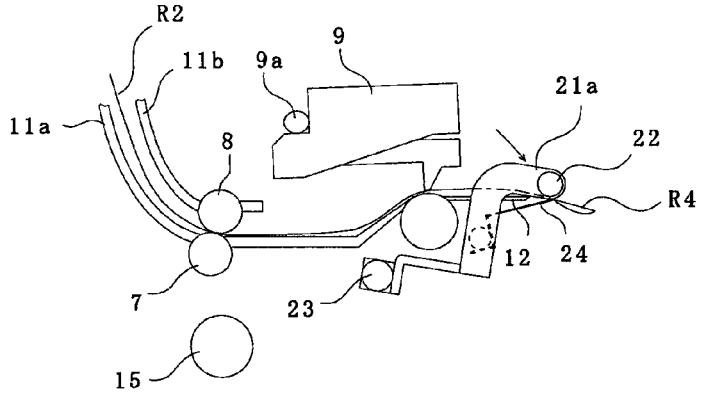
Figure 6:
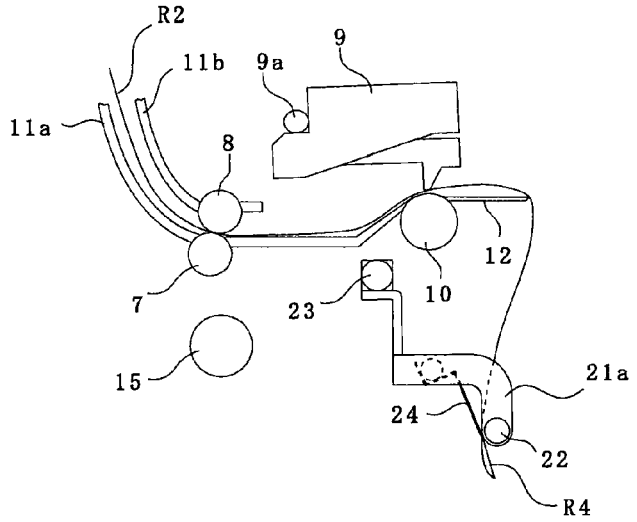
Figure 6:
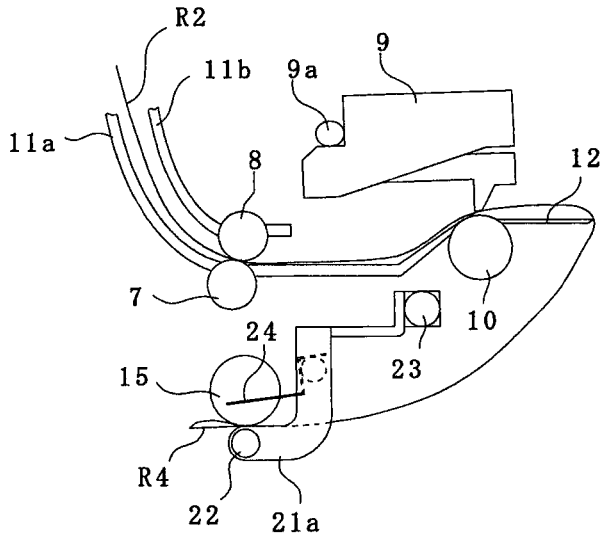
Figure 6:
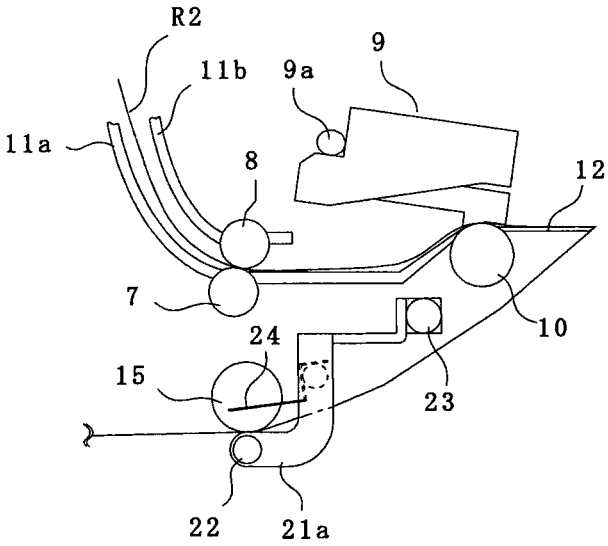

FIGS. 5(*a*) to 5(*k*) are figures showing operation of the labeling device according to the present invention. FIGS. 6(*a*) to 6(*e*) are enlarged drawings of the guide unit 20 and the printing head 9 corresponding to FIGS. 5(*f*) to 5(*j*).

FIG. 5(*a*) shows the state where the label roll R is not set in the labeling device.

If a user puts the label roll R onto the guide frame 2, the roller 3 will be rotated by the motor (not shown in figure). And then the label roll R is rotated in the clockwise direction by the roller 3 (FIG. 5(*b*)).

While the label roll R is rotating in the clockwise direction, the leading edge R4 of the label holding band R2 of the label roll R passes through between the guiding part 2*a* and the guide plates 11*b* and then the leading edge R4 enters between the first loading rollers 5 and 6 (FIG. 5 (*c*)). If the leading edge R4 of label holding band R2 enters between the first loading rollers 5 and 6, the first loading rollers 5 and 6 nip the leading edge R4 between them, and then send the leading edge R4 of label holding band R2 below (FIG. 5(*d*)).

After that, the label holding band R2 of the label roll R is fed below along the guide plates 11*a* and 11*b* by the first loading rollers 5 and 6, the leading edge R4 of the label holding band R2 enters between the second loading rollers 7 and 8 so that the second loading rollers 7 and 8 nip the leading edge R4 between them, and then the label holding band R2 is fed toward the printing head 9 by the second loading rollers 7 and 8 (FIG. 5(*e*)).

At this time, the printing head 9 is held in the position in which it separates from the platen roller 10. The leading edge R4 of the label holding band R2 of the label roll R passes through between the printing head 9 and the platen roller 10, and is fed to the front of the peeling member 12 (FIG. 5(*f*) and FIG. 6(*a*)).

When the leading edge R4 of the label holding band R2 of the label roll R reaches the front of the peeling member 12, the frame body 21 of the guide unit 20 will be turned in the clockwise direction together with the shaft 23 by the motor which is not shown. Thereby, the label fitting plate 24 is separated from the peeling member 12. As a result, the leading edge R4 of the label holding band R2 of the label roll R is nipped and held by the guiding roller 22 and the label fitting plate 24 (FIGS. 5(*g*) and 6(*b*)).

The frame body 21 of the guide unit 20 is turned to the left-hand side, nipping the leading edge R4 of the label holding band R2 of the label roll R by the guiding roller 22 and the label fitting plate 24 (FIGS. 5(*h*) and 6(*c*)). When the frame body 21 of the guide unit 20 is turned to the most left-hand side, the guiding roller 22 of the guide unit 20 will contact with the feeding roller 15 via the label holding band R2 (FIGS. 5(*i*) and 6(*d*)). At this time, the label fitting plate 24 is simultaneously turned up against the force of the axial spring, so that the leading edge R4 of the label holding band R2 is nipped by the guiding roller 22 and the feeding roller 15.

If the feeding roller 15 is turned in the clockwise direction by the motor not shown in figures from this state, the leading edge R4 of the label holding band R2 of the label roll R will be fed toward the label holding band rolling-up roller 16 and then enters into the gap between the first member 16*a* and the second member 16*b* (FIG. 5(*j*)).

A predetermined tensile force is applied to the label holding band R2 of the label roll R by the above-mentioned operation of the roller 15 so that the label holding band R2 will be bent at the acute angle by the peeling plate 12 (FIGS. 5(*j*) and 6(*e*)). At this time, the printing head 9 is rotated by the pivot shaft 9*a*, and comes to the position in which it contacts with the platen roller 10 via the label holding band R2. As a result, the printing head 9 will be in the state in which the head 9 is able to print.

The label holding band rolling-up roller 16 is turned in the clockwise direction, putting in the leading edge R4 of the label holding band R2 of the label roll R between the first member 16*a* and second member 16*b* in order to roll up the label holding band R2 (FIG. 5(*k*).

As described above, in the labeling device concerning to this embodiment, if a user puts the label roll R on the guide frame 2 in the predetermined direction, the leading edge R4 of the label holding band R2 of the label roll R is automatically pulled out from the label roll R and is automatically brought to the label holding band rolling-up roller 16. As a result, the labeling device will automatically be in the state where a label can be stuck.

A remaining amount detection means which detects the remaining amount of the label roll R is further provided on the labeling device constituted as described above.

Figure 7:
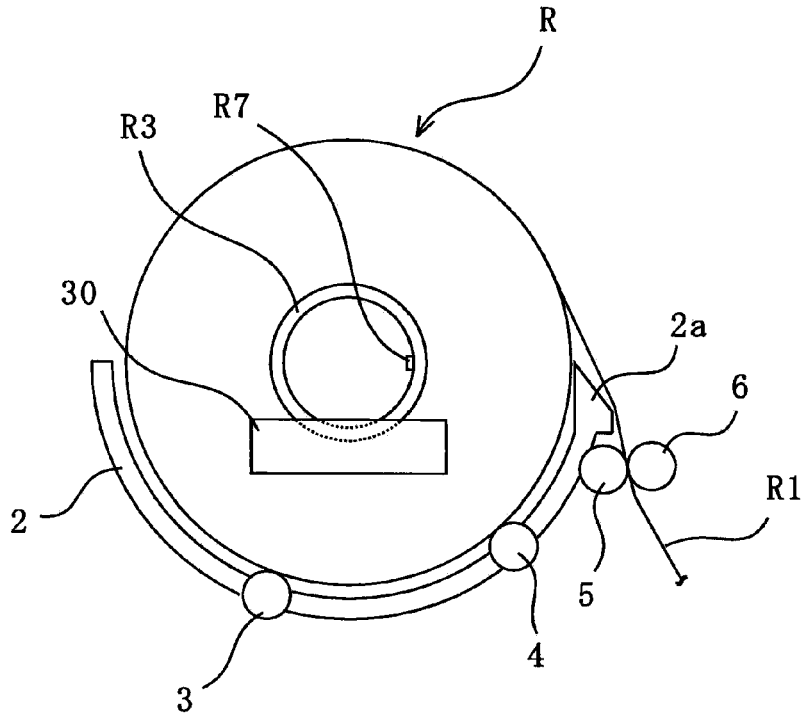
FIGS. 7 (*a*) and (*b*) are figures each showing the arrangement of a remaining amount detection means for the label roll.
Figure 7:
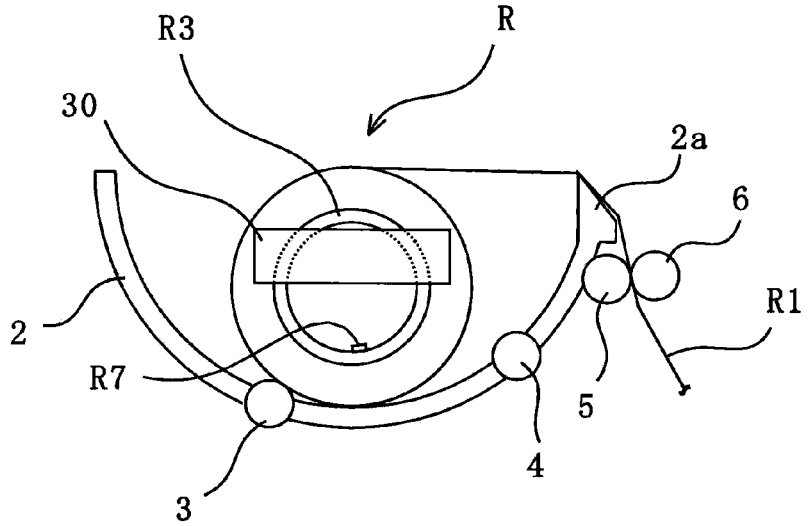
Figure 8:
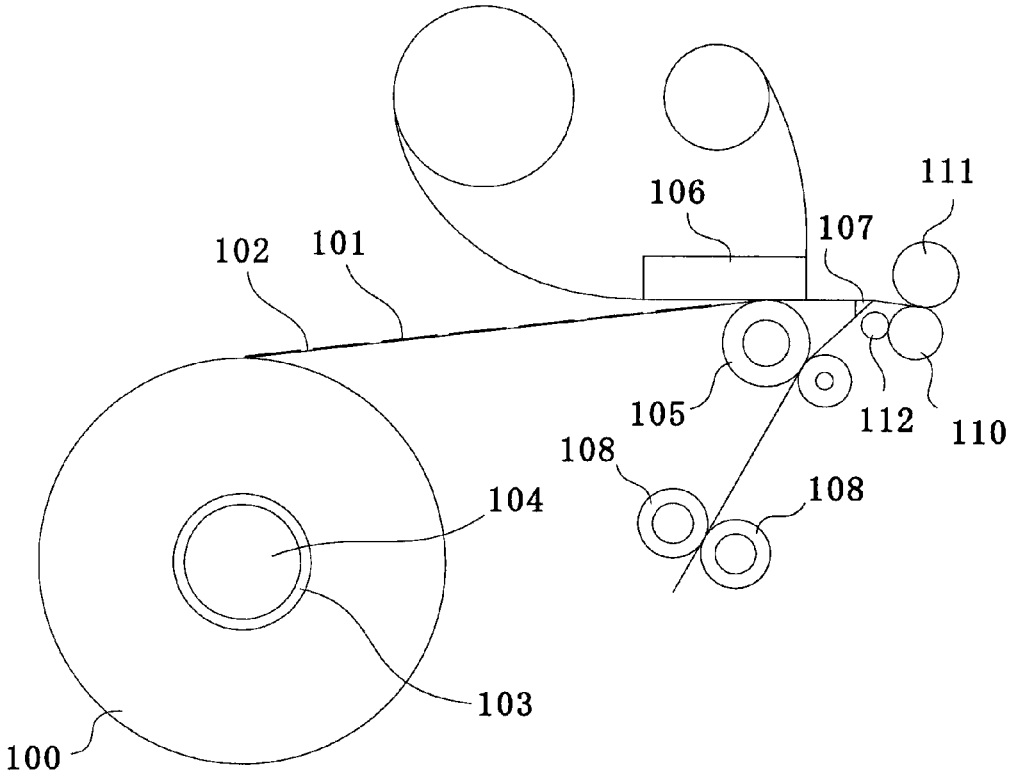
FIG. 8 is a schematic diagram showing the construction of the conventional labeling device.

As shown in FIG. 7, the remaining amount detection means 30 comprises the array of a plurality of magnetic detection sensors, and is arranged in the position of the guide frame 2, which overlaps with the lowest portion of the core R3 when new label roll R is put on the guide frame 2.

A magnet R7 is provided on the core R3, and the remaining amount detection means 30 detects magnet R7 provided on the core R3 by the magnetic detection sensor thereof.

The signal detected by the remaining amount detection means 30 is transmitted to a control device not shown in figures, and the control device computes the revolving speed of the core R3 based on the detection signal from the remaining amount detection means 30. When the labeling device is operating, the label holding band R2 is pulled out at the same speed from the label roll R. Therefore, as there are many residual of the label roll R, the revolving speed of winding core R3 is slower. In proportion to the residual of the label roll R decreasing, the revolving speed of winding core R3 becomes quick. A control device computes the amount of residual of the label roll R based on the revolving speed of the core R3 according to the above principle.

In the embodiment above described, the labeling device comprises the printer which has the printing head 9, the ribbon feeding roller 13, and the ribbon rolling-up roller 14. However, the printer is not an essential subject matter of the labeling device according to the present invention. For example, in the case of the labeling device is used to only put the label in which a certain information is pre-printed on the test tube or the like, it is not necessary to provide the printer on the labeling device.

Although the label holding band rolling-up roller 16 which rolls up the label holding band R2 is provided on the labeling device in the above-mentioned embodiment, the label holding band rolling-up roller 16 is not essential subject matter of the labeling device according to the present invention, it is not necessary to provide it on the labeling device.

The invention claimed is:

1. A labeling device comprising a guide frame rotatably supporting a label roll formed by winding around a core a label holding band which releasably holds a plurality of labels in series and a peeling member which peels the printed label from the label holding band by bending the label holding band at an acute angle towards a slanting lower part in relation to the direction of movement of the label holding band, wherein the labeling device comprises a guide unit that is pivotally provided for nipping and holding a leading edge of the label holding band in front of the peeling member and is intended to be rotated around the peeling member with the nipped and held leading edge of the label holding band so that the leading edge of the label holding band is brought to a feeding roller arranged on the slanting lower part of the peeling member in relation to the direction of the movement of the label holding band.

2. The labeling device according to claim 1, wherein at least one pair of loading rollers are provided between the guide frame and the peeling member, and the label holding band is passed through between said loading rollers and is fed to the peeling member by rotating the loading rollers.

3. The labeling device according to claim 2, wherein the guide unit comprises a guiding roller and a label fitting plate which are intended to nip the leading edge of the label holding band between them in front of the peeling member, the guide unit is rotated to bring the leading edge of the label holding band to the feeding roller, and when the leading edge is brought to the feeding roller, the leading edge is nipped between the guiding roller and the feeding roller and the label holding band is pulled out by the feeding roller.

4. The labeling device according to claim 2, wherein the guide frame comprises a guiding part having the inclined portion towards the outside, and said at least one loading rollers is arranged under the guiding part.

5. The labeling device according to claim 2, wherein a printing head is arranged between the loading rollers and the peeling member for printing any information on a label on the label holding band pulled out from the label roll.

6. The labeling device according to claim 5, wherein a platen roller is arranged under the printing head, the printing head has a pivot axis at the one end opposite to the platen roller and be rotatable about the pivot axis, until tensile force is applied to the label holding band by the feeding roller the printing head is rotated to the position in which the printing head is away from the platen roller, and after the suitable tensile force is applied to the label holding band the printing head is rotated about the pivot axis to the position in which the printing head is contacted with the platen roller via the label holding band.

7. The labeling device according to claim 6, wherein the guide frame comprises a guiding part having the inclined portion towards the outside, and said at least one loading rollers is arranged under the guiding part.

8. The labeling device according to claim 5, wherein the guide unit comprises a guiding roller and a label fitting plate which are intended to nip the leading edge of the label holding band between them in front of the peeling member, the guide unit is rotated to bring the leading edge of the label holding band to the feeding roller, and when the leading edge is brought to the feeding roller, the leading edge is nipped between the guiding roller and the feeding roller and the label holding band is pulled out by the feeding roller.

9. The labeling device according to claim 5, wherein the guide frame comprises a guiding part having the inclined portion towards the outside, and said at least one loading rollers is arranged under the guiding part.

10. The labeling device according to claim 1, wherein the guide unit comprises a guiding roller and a label fitting plate which are intended to nip the leading edge of the label holding band between them in front of the peeling member, the guide unit is rotated to bring the leading edge of the label holding band to the feeding roller, and when the leading edge is brought to the feeding roller, the leading edge is nipped between the guiding roller and the feeding roller and the label holding band is pulled out by the feeding roller.

11. The labeling device according to claim 1, wherein the guide frame comprises a guiding part having the inclined portion towards the outside, and said at least one loading rollers is arranged under the guiding part.

* * * * *